US007610858B2

(12) United States Patent
Chung

(10) Patent No.: US 7,610,858 B2
(45) Date of Patent: Nov. 3, 2009

(54) LIGHTWEIGHT POLYMER CASED AMMUNITION

(76) Inventor: Sengshin Chung, 26 Robert St., Parsippany, NJ (US) 07054

( * ) Notice: Subject to any disclaimer, the term of this patent is extended or adjusted under 35 U.S.C. 154(b) by 45 days.

(21) Appl. No.: 11/560,726

(22) Filed: Nov. 16, 2006

(65) Prior Publication Data

US 2007/0261587 A1 Nov. 15, 2007

Related U.S. Application Data

(60) Provisional application No. 60/754,091, filed on Dec. 27, 2005.

(51) Int. Cl.
*F42B 5/307* (2006.01)
*F42B 5/313* (2006.01)

(52) U.S. Cl. ..... 102/466

(58) Field of Classification Search ..... 102/464–467, 102/469, 470, 516, 517
See application file for complete search history.

(56) References Cited

U.S. PATENT DOCUMENTS 3,144,827 A * 8/1964 Boutwell ..... 102/466
3,424,089 A * 1/1969 Humpherson ..... 102/466
4,614,157 A * 9/1986 Grelle et al. ..... 102/466
4,726,296 A 2/1988 Leshner et al.

(Continued)

OTHER PUBLICATIONS

Donnard, Reed. E.; Leshner, Ervin; Development of Cartridge, Caliber .50, Blank; XM 928, U.S. Army Armament Research, Sep. 19, 1986.

(Continued)

*Primary Examiner*—Bret Hayes
(74) *Attorney, Agent, or Firm*—Fox Rothschild, LLP; Peter J. Butch, Esq.; Dennis M. Carleton, Esq.

(57) ABSTRACT

An ammunition cartridge assembled from (1) a substantially cylindrical polymeric cartridge casing body defining a casing headspace with an open projectile-end and an end opposing the projectile-end, wherein the casing body has (A) a substantially cylindrical injection molded polymeric bullet-end component with opposing first and second ends, the first end of which is the projectile-end of the casing body and the second end has a male or female coupling element; and (B) a cylindrical polymeric middle body component with opposing first and second ends, wherein the first end has a coupling element that is a mate for the projectile-end coupling element and joins the first end of the middle body component to the second end of the bullet-end component, and the second end is the end of the casing body opposite the projectile end and has a male or female coupling element; and (2) a cylindrical cartridge casing head-end component with an essentially closed base end with a primer hole opposite an open end with a coupling element that is a mate for the coupling element on the second end of the middle body and joins the second end of the middle body component to the open end of the head-end component; wherein the middle body component is formed from a material more ductile than the material head-end component is formed from but equal or less ductile than the material the bullet-end component is formed from. Methods for assembling ammunition cartridges and ammunition cartridges having the headspace length larger than the corresponding headspace length of the chamber of the intended weapon measured at the same basic diameter for the cartridge casing without being so large as to jam the weapon or otherwise interfere with its action are also disclosed.

57 Claims, 15 Drawing Sheets

U.S. PATENT DOCUMENTS

| | | | | | |
|---|---|---|---|---|---|
| 4,770,098 | A | | 9/1988 | Stoner | |
| 4,770,445 | A | | 9/1988 | Steer et al. | |
| 4,782,758 | A | | 11/1988 | Washburn | |
| 4,913,054 | A | * | 4/1990 | Petersen | 102/439 |
| 4,938,145 | A | * | 7/1990 | Martwick | 102/434 |
| 5,029,530 | A | | 7/1991 | Martwick et al. | |
| 5,048,423 | A | | 9/1991 | Garrett | |
| 5,067,407 | A | | 11/1991 | Martwick | |
| 5,069,137 | A | | 12/1991 | Martwick | |
| 5,151,555 | A | | 9/1992 | Vatsvog | |
| 5,165,040 | A | * | 11/1992 | Andersson et al. | 102/464 |
| 5,323,707 | A | * | 6/1994 | Norton et al. | 102/431 |
| 5,385,101 | A | * | 1/1995 | Corzine et al. | 102/509 |
| 5,388,522 | A | | 2/1995 | Martwick et al. | |
| 5,400,715 | A | | 3/1995 | Roach et al. | |
| 5,563,365 | A | * | 10/1996 | Dineen et al. | 102/431 |
| 5,841,063 | A | | 11/1998 | Hellkvist et al. | |
| 6,019,217 | A | | 2/2000 | Melan et al. | |
| 6,041,712 | A | * | 3/2000 | Lyon | 102/439 |
| 6,048,379 | A | * | 4/2000 | Bray et al. | 75/229 |
| 6,367,388 | B1 | | 4/2002 | Billings | |
| 6,457,603 | B1 | * | 10/2002 | Freist et al. | 220/678 |
| 6,575,097 | B1 | | 6/2003 | Nodarse et al. | |
| 6,748,870 | B2 | * | 6/2004 | Heidenreich et al. | 102/431 |
| 6,752,084 | B1 | | 6/2004 | Husseini et al. | |
| 6,827,756 | B2 | * | 12/2004 | Park et al. | 75/248 |
| 6,845,716 | B2 | | 1/2005 | Husseini et al. | |
| 6,988,450 | B1 | * | 1/2006 | Georgantzis et al. | 102/401 |
| 7,024,999 | B2 | * | 4/2006 | Muskat et al. | 102/431 |
| 7,059,234 | B2 | | 6/2006 | Husseini et al. | |
| 7,225,741 | B2 | * | 6/2007 | Huffman | 102/434 |
| 2001/0013299 | A1 | * | 8/2001 | Husseini et al. | 102/466 |
| 2005/0005807 | A1 | * | 1/2005 | Wiley et al. | 102/517 |
| 2005/0066849 | A1 | * | 3/2005 | Kapeles et al. | 102/517 |
| 2005/0081704 | A1 | | 4/2005 | Husseini | |
| 2005/0115446 | A1 | * | 6/2005 | Heitmann et al. | 102/469 |
| 2005/0183612 | A1 | * | 8/2005 | Huffman | 102/434 |
| 2005/0188883 | A1 | * | 9/2005 | Husseini et al. | 102/466 |
| 2005/0257711 | A1 | * | 11/2005 | Husseini et al. | 102/466 |
| 2005/0257712 | A1 | * | 11/2005 | Husseini et al. | 102/466 |
| 2006/0027125 | A1 | * | 2/2006 | Brunn | 102/464 |
| 2006/0207464 | A1 | * | 9/2006 | Maljkovic et al. | 102/466 |

OTHER PUBLICATIONS

Oakley, William; De Piero William S.; Davis, David W.; Keyes, Andrew; Candidate Plastics for Cartridge Cases and Weapon Components, Advanced Medium Machine Gun, U.S. Army Armament Research, Report No. 388, Nov. 1992.

Oakley, William C.; De Piero William S.; Davis, David W.; Keyes, Andrew; Candidate Plastics for Cartridge Cases and Weapon Components, Advanced Medium Machine Gun, U.S. Army Armament Research, Technical Report ARAED-TR-93001, Jun. 1993.

Shibley, Allen M.; Plastic Materials for Cartridge Cases, Plastics Technical Evaluation Center, Plastec report R44, Jan. 1973.

Seger, Stephen G. Jr.; Thelen, Edmund; Feasibility Study of the Manufacture of 7.62 mm Cartridge Cases from Plastic Materials, The Franklin Institute, Laboratories for Research and Development, Final Report No. F-A2266, Oct. 31, 1960.

Wogsland, Neal S.; Plastic 5.56 mm Blank Cartridge, Army Land Warfare Laboratory, Technical Report No. 74-31 (AD/A-003222), Jun. 1974.

* cited by examiner

LIGHTWEIGHT POLYMER CASED AMMUNITION

CROSS-REFERENCE TO RELATED APPLICATIONS

The present application claims priority benefit of U.S. Provisional Patent Application No. 60/754,091 filed Dec. 27, 2005, the entire contents of all of which are hereby incorporated by reference.

FIELD OF THE INVENTION

The present invention relates to ammunition articles and, more particularly to ammunition articles with plastic components such as injection molded polymeric cartridge casings.

BACKGROUND OF THE INVENTION

Advances in weapon systems have resulted in soldiers carrying additional gear to enhance combat effectiveness, but at the cost of increased weight. Today soldiers on combat patrols in Afghanistan typically carry 92 to 105 pounds of mission-essential equipment which includes extra ammunition, chemical protective gear and cold-weather clothing. The overload causes fatigue, heat stress, injury, and performance degradation for soldiers. To ensure that America's soldiers maintain their overwhelming combat edge into the 21 st century, making the load lighter for soldiers has moved to the top of the priority list in the Army.

Despite years of research and development, the Army's weapons and equipment is still too heavy to allow foot soldiers to maneuver safely under fire. One of the heaviest pieces of load for soldiers is the ammunition. Every solider has to carry a lot of ammunition during combat. For example, the weight of 0.50 caliber ammunition is about 60 pounds per box (200 cartridges plus links). It is burdensome for a soldier to move around with heavy ammunition aside from carrying additional gear at the same time. Conventional ammunition cartridge cases for rifles and machine guns, as well as larger caliber weapons, are usually made from brass, which is heavy, expensive, and potentially hazardous. There exists a need for an affordable lighter weight replacement for brass ammunition cartridge cases that can increase mission performance and operational capabilities.

As early as 1960, the U.S. military has recognized the benefits of using polymer or polymer composite materials for cartridge case applications, and since then much research has been carried out by the military and ammunition industry, The previous studies have demonstrated feasibility but have not achieved consistent and reliable ballistic results. Recent efforts have focused on a two-piece metal and plastic hybrid cartridge case design which encountered numerous failures. On the civilian side, the development effort focused on low-pressure and low muzzle-speed cartridge case applications.

Lightweight polymer cartridge casing ammunition must meet the reliability and performance standards of existing fielded ammunition and be interchangeable with brass cartridge casing ammunition in existing weaponry. At the same time, the light-weight polymer cartridge casing ammunition must be capable of surviving the physical and natural environment to which it will be exposed during the ammunition's intended life cycle. In addition, the polymeric cartridge casings should require little to no modification of conventional ammunition manufacturing equipment and methods.

To date, polymeric cartridge casings have failed to provide satisfactory ammunition with sufficient safety, ballistic and handling characteristics. Most plastic materials, however, even with a high glass fiber loading, have much lower tensile strength and modulus than brass. Existing polymer/composite casing technologies as a result have many shortcomings, such as insufficient ballistic performance, cracks on the case mouth, neck, body and/or base, bonding failure of metal-plastic hybrid cases, difficult extraction from the chamber, incompatibility with propellant (particularly for double base propellants), insufficient high temperature resistance (burn holes) and chamber constraints produced by thicker case walls.

Other shortcomings include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing weapon jam or damage or danger when subsequent rounds are fired or when the casing portions themselves become projectiles.

To overcome the above shortcomings, improvements in cartridge case design and performance polymer materials are needed.

SUMMARY OF THE INVENTION

This need is met by the present invention. By using an innovative polymer casing design and identifying appropriate polymeric materials, the present invention provides a polymeric cased cartridge with up to 40% weight saving per cartridge than existing corresponding brass cased cartridge, while at the same time meeting military performance requirements.

The present invention incorporates the discovery that the shortcomings experienced with prior art polymeric ammunition cartridges can be overcome by a casing design that achieves a strong and reliable metal-plastic joint interface. Therefore, according to one aspect of the present invention, an ammunition cartridge is provided having:

(1) an injection molded substantially cylindrical polymeric cartridge casing body with an open projectile-end and an open end opposing the projectile-end, in which the cartridge casing has:

(A) a substantially cylindrical injection molded polymeric bullet-end component with opposing first and second ends, the first end of which is the projectile-end of the casing body and the second end has a male or female coupling element; and (B) a cylindrical polymeric middle body component with opposing first and second ends, wherein the first end has a coupling element that is a mate for the bullet-end coupling element and thereby joins the first end of the middle body component to the second end of the bullet-end component, and the second end of the middle body component is the end of the casing body opposite the projectile end and has a male or female coupling element; and (2) a cylindrical cartridge casing head-end component having an essentially closed base end with a primer hole opposite an open end having a coupling element that is a mate for the coupling element on the second end of the middle body component and thereby joins the second end of the middle body component to the open end of the of the casing head-end component;

wherein the middle body component is formed from a material that is more ductile than the material from which the head-end component is formed but equal or less ductile than the material from which the bullet-end component is formed.

The bullet-end and middle body components are made of either polymer or fiber reinforced polymer composite. Injection molding of the polymer and polymer composite components maximizes the interior volume by permitting the formation of narrow-walled components. The same or different polymers can be used in the construction of the two components. Either or both components can be fiber reinforced polymer composite or un-reinforced ductile polymer. In one embodiment, the middle body component and the bullet-end component are formed from the same high temperature resistant ductile polymer.

The middle body component can have a male coupling element on both ends, in which case both the second end of the bullet-end component and the open end of the casing head-end component will have female coupling elements. The middle body component can also have a female coupling element on both ends, in which case both the second end of the bullet-end component and the open end of the casing head-end component will have male coupling elements. The middle body component can also have a male coupling element on one end and a female coupling element on the other end and the second end of the bullet-end component and the open end of the casing head-end component will have the mate for the coupling element on the end of the middle body component to which it is joined. The tips of the coupling elements may be tapered on both ends to facilitate insertion.

In one embodiment the first end of the middle body component has a female coupling element and the second end of the bullet-end component has a male coupling element, wherein the male coupling element of the bullet-end component is dimensioned to achieve an interference fit within and engage the female coupling element of the middle body component. The interference fit between the middle-body component and the bullet-end component can be accomplished when the inner diameter (ID) of the female coupling element is equal or smaller than the outer diameter (OD) of the male coupling element. In the same embodiment, the second end of the middle body component has a male coupling element, and the open end of the casing head-end component has a female coupling element, wherein the male coupling element of the middle-body component is similarly dimensioned to achieve an interference fit or simply fit within and engage the female coupling element of the head end component The head-end component is made of high strength polymer, polymer composite, ceramic or metal. Preferably the head-end component is made of metal, more preferably aluminum, steel or brass. The head-end and middle body components may be joined by adhesive bonding, interference fit, snap-fit joint or an injection molded-in joint. The middle body and bullet-end components may be joined by adhesive bonding, solvent welding, spin welding, vibration welding, ultrasonic welding or laser welding.

The bullet-end component has a neck with an inner diameter preferably tapering to the projectile end, within which the projectile is seated and secured. The inner diameter of the neck is dimensioned to achieve an interference fit with the circumference of the projectile. The projectile may be held in place in the casing neck by interference fit, crimping or mechanical fastening.

The projectile end of the casing neck may also have an internal recess adapted to receive and hold in place the projectile. In an alternate embodiment, the bullet-end component may be made of a ductile polymer and is molded with a plurality of internal structures for supporting the projectile and holding it in place.

Polymers suitable for molding of the bullet-end component have one or more of the following properties:

Yield or tensile strength at −65° F.>10,000 psi
Elongation-to-break at −65° F.>15%
Yield or tensile strength at 73° F.>8,000 psi
Elongation-to-break at 73° F.>50%
Yield or tensile strength at 320° F.>4,000 psi
Elongation-to-break at 320° F.>80%

Polymers suitable for molding of the middle body component have one or more of the following properties:

Yield or tensile strength at −65° F.>10,000 psi
Yield or tensile strength at 73° F.>8,000 psi
Yield or tensile strength at 320° F.>4,000 psi Preferred polymers for use in the present invention meet all of the foregoing properties. Commercially available polymers suitable for use in the present invention thus include polyphenylsulfones, and copolymers of polyphenylsulfones with polyethersulfones or polysulfones, and copolymers and blends thereof with poly-siloxanes; poly(etherimide-siloxane) copolymers and blends of polyetherimides and polysiloxanes, and blends of polyetherimides and poly(etherimide-siloxane) copolymers; and the like. The polymer can be formulated with up to 10 wt % of one or more additives, including but not limited to internal mold release agents, heat stabilizers, flow promoter, anti-static agents, UV stabilizers and colorants.

The foregoing polymers can also be used for conventional two-piece metal-plastic hybrid cartridge case designs and conventional shotgun shell designs. Therefore, according to another aspect of the present invention, an ammunition cartridge is provided having:

(1) a one-piece substantially cylindrical polymeric cartridge casing body with an open projectile-end and an end opposing the projectile-end with a male or female coupling element; and (2) a cylindrical metal cartridge casing head-end component having an essentially closed base end with a primer hole opposite an open end having a coupling element that is a mate for the coupling element on the opposing end of the polymeric cartridge casing body joining the open end of the head-end component to the opposing end of the polymeric cartridge casing body;

wherein the polymeric cartridge casing body is formed from a polymer having one or more of the following properties:

Yield or tensile strength at −65° F.>10,000 psi
Elongation-to-break at −65° F.>15%
Yield or tensile strength at 73° F.>8,000 psi
Elongation-to-break at 73° F.>50%
Yield or tensile strength at 320° F.>4,000 psi
Elongation-to-break at 320° F.>80%.

The headspace gap between a cartridge casing and the weapon chamber is crucial to casing performance. Too large of a headspace gap will cause a casing to rupture. The present invention incorporates the discovery that this is more of an issue with polymeric casings as opposed to brass casings because the headspace gap between a polymeric casing and weapon chamber at extreme low temperatures can be excessive because of the high coefficient of thermal expansion of polymers as compared to brass.

The present invention incorporates the recognition that the cartridge casing design must take this circumstance into consideration so that polymer casing ammunition can function reliably at all temperatures in all weapons systems. The cartridge casings of the present invention are specifically designed to take advantage of the compressibility and recoverability of polymers to provide polymer cartridge casings that address the headspace gap issue resulting from weapon variations and temperature extremes.

Accordingly, ammunition cartridge casings according to one embodiment of the present invention have a headspace length dimension that is larger than the corresponding headspace length dimension of the chamber of the intended weapon, measured at the same basic diameter for the cartridge casing at 73° F., without being so large as to jam the weapon or otherwise interfere with its action, so that at lower temperatures the headspace gap is not so large as to result in rupture of the casing. The mechanical properties of plastic compared to brass permit the use of such a design, permitting the weapon's bolt to compress the cartridge casing slightly to close the firing chamber. Cartridge casings according to this embodiment of the present invention should be between about 0.001 and about 0.030 inches larger than the corresponding chamber headspace, and preferably between about 0.002 and about 0.008 inches larger.

Military specification Mil-C-63989-C establishes specifications as of the filing date of the present invention for the 5.56 mm M855 ball cartridges. The present invention incorporates the discovery of polymeric materials and casing designs for polymeric cartridges that meet the requirements of this and other existing military specifications, including requirements for bullet pull strength. Therefore, according to another embodiment of the present invention polymer ammunition cartridge casings are provided in which the neck of the bullet-end component has an inner diameter smaller than the projectile base diameter at the same location before the projectile base is seated into the cartridge casing.

The inner diameter at the projectile end is preferably no more than about 0.002 inches larger but no more than 0.008 inches smaller than the projectile diameter. At the opposite end of the neck, where the projectile is seated, the inner diameter is between about 0.002 and about 0.025 inches smaller than the diameter of the projectile, preferably between about 0.004 and about 0.010 inches smaller, and more preferably between about 0.005 and 0.008 inches smaller.

The ammunition cartridge may be assembled without modification of exiting production lines. A primer is centrally mounted on the base of the head-end component, with the primer and head-end component serving to close the end of the casing opposite the projectile end. The casing is filled with a particulate or consolidated propellant, and a projectile is mounted on the projectile-end of the casing.

The present invention also includes methods by which the ammunition cartridge casings of the present invention are made. Therefore, according to another aspect of the present invention, a method is provided for assembling an ammunition cartridge according to the following steps:

(1) mating a cylindrical cartridge casing head-end component having an essentially closed base end with a primer hole opposite an open end having a coupling element to a cylindrical polymeric middle body component with opposing first and second ends, wherein the first end has a male or female coupling element and the second end has a coupling element that is a mate for the coupling element of the head-end component;

(2) providing a substantially cylindrical injection molded polymeric bullet-end component with opposing first and second ends, the first end of which is the projectile-end of the casing body and the second end has a coupling element that is a mate for the coupling element on the first end of the middle body component; and (3) mating the first end of the middle body component to the second end of the bullet-end component; and wherein the middle body component is formed from a material that is more ductile than the material from which the head-end component is formed but equal or less ductile than the material from which the bullet-end component is formed.

The middle body component can be mated to the head-end component either by injection molding the middle body component onto the head-end component or by snap-fitting the two components together. The bullet-end component can also be snap-fit or interference fit to the middle body component. The individual components are otherwise formed by essentially conventional means and may be welded or bonded together by conventional techniques for joining polymeric materials to the same or different polymer, ceramic or metal.

Once assembled, the cartridge casing can be loaded with propellant and assembled with a projectile. This can be performed in-line, or the cartridge casings can be transported to a different location to be filled with propellant and joined to a projectile, and without significant modification of existing production lines for filling brass cartridge casings and mounting projectiles thereon.

The foregoing and other objects, features and advantages of the present invention are more readily apparent from the detailed description of the preferred embodiments set forth below, taken in conjunction with the accompanying drawings.

DETAILED DESCRIPTION OF THE PREFERRED EMBODIMENTS

Figure 1:
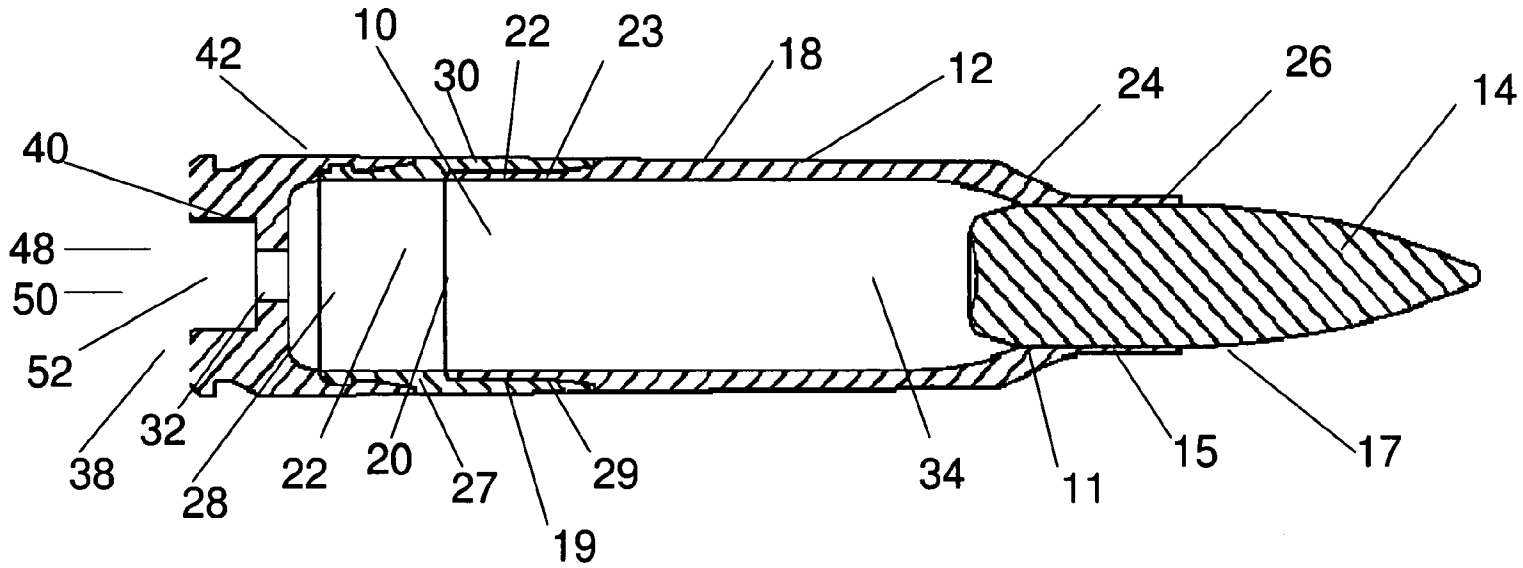
FIG. 1 depicts a side, cross-sectional view of a polymeric cartridge case according to a first embodiment of the present invention in which the middle body component has a female coupling element on the end which mates with the bullet end component and a male coupling element on the end which mates with the head end component.
Figure 3:
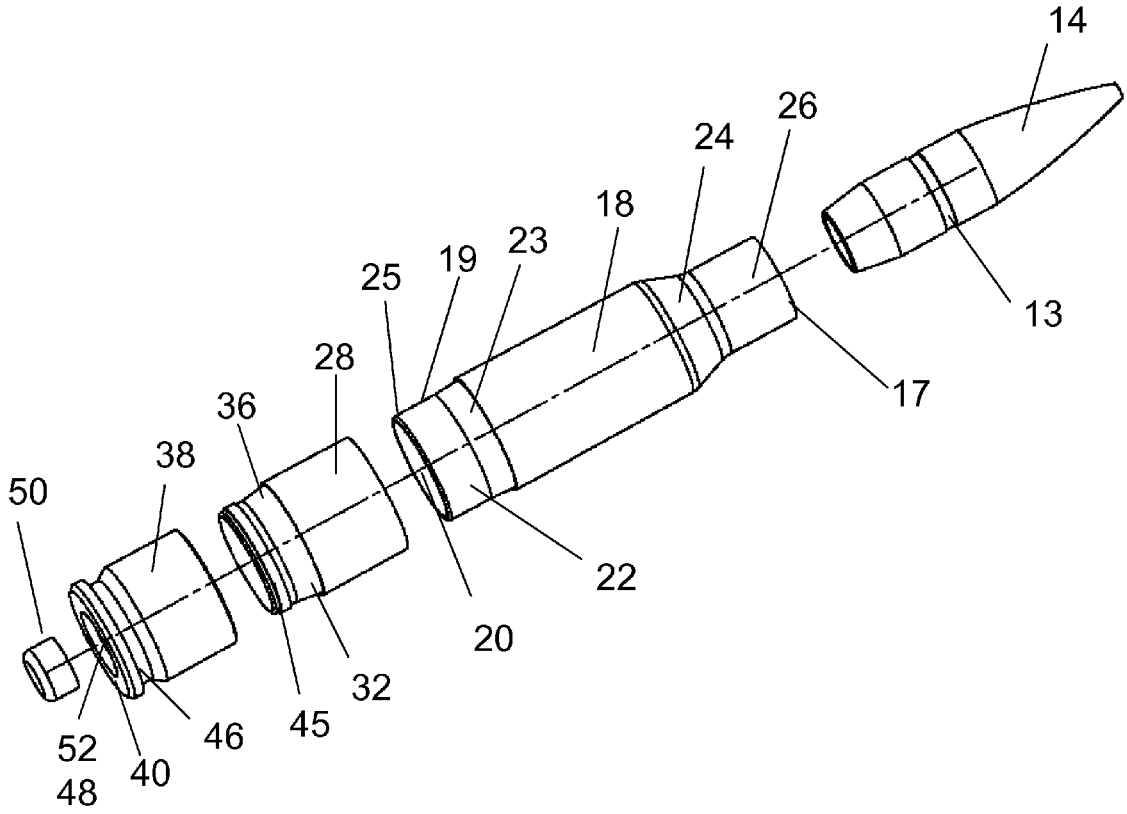
FIG. 3 depicts an exploded view of the polymeric cartridge casing of FIG. 1.

Referring particularly to the drawings, wherein like figures indicate like parts, there is depicted in FIG. 1 a side, cross-sectional view of one embodiment of the present invention. An exploded view of the same embodiment is depicted in FIG. 3. A rifle cartridge 10 suitable for use with high velocity rifles is shown manufactured with a polymer casing 12 open at both ends with projectile 14 inserted into the forward end opening 16. Polymer casing 12 has a substantially cylindrical open-ended polymeric bullet-end component 18 extending from forward end opening 16 rearward to the opposite end 20. The bullet-end component 18 is injection molded with coupling element 22 formed on end 20. Coupling element 22 is shown in FIG. 1 as a male element, but may also be configured as a female element in alternate embodiments of the invention. The forward end of bullet-end component 18 has a shoulder 24 forming chamber neck 26. The bullet-end component typically has a wall thickness between about 0.005 and about 0.150 inches and more preferably between about 0.010 and about 0.050 inches.

Polymer casing 12 also has a substantially cylindrical open-ended middle body component 28. The middle body component extends from a first end with a coupling element 30 to a second end with a coupling element 32. The middle body component typically has a wall thickness between about 0.005 and about 0.150 inches and more preferably between about 0.010 and about 0.050 inches. Coupling element 30, as shown in FIGS. 1 and 1*b* is configured as a female element, while coupling element 32 is configured as a male element however, all combinations of male and female configurations is acceptable for coupling elements 30 and 32 in alternate embodiments of the invention.

Coupling element 22 of bullet-end component 18 fits within and engages coupling element 30 of middle body component 28. Specifically, as shown in FIGS. 1 and 1*d*, coupling element 22 of bullet-end component 18 is configured as a male element formed with a straight interference fit or tapered interlock fit or combination of both fit surface 19 adapted to mate and fit with deformable skirt 21 of coupling element 30 on middle body component 28, which is configured as a female element.

Figure 1A:
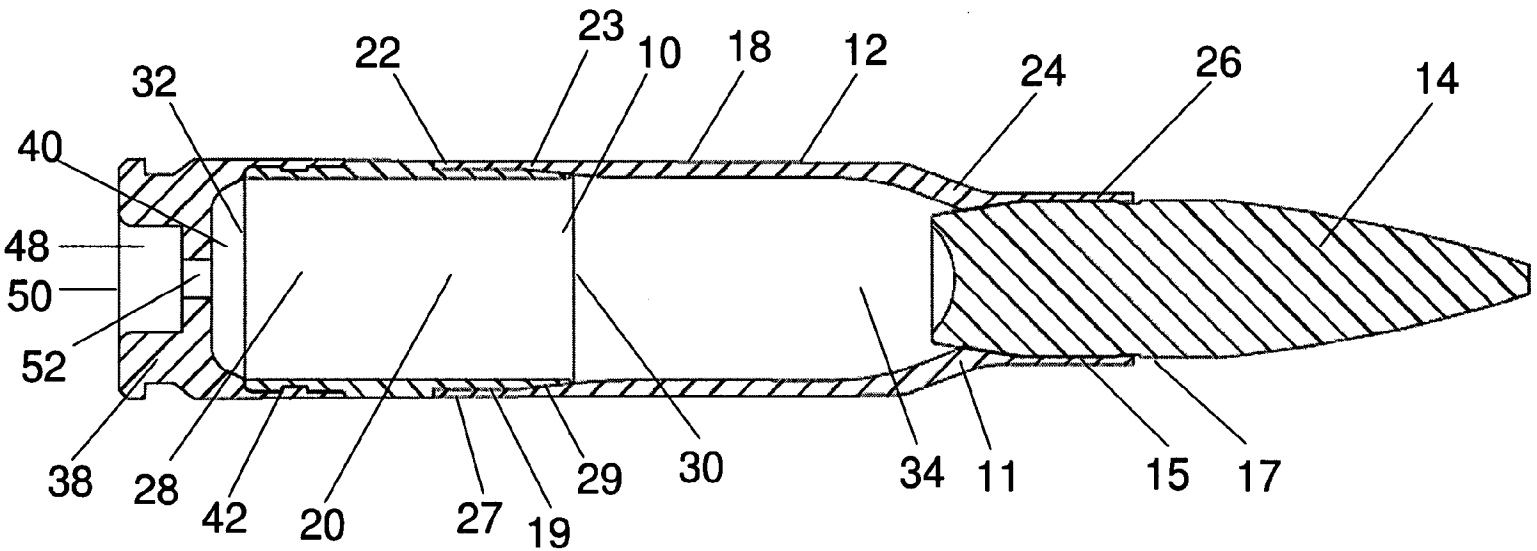
FIG. 1*a* depicts a side, cross-sectional view of a polymeric cartridge case according to a second embodiment of the present invention in which the middle body component has a male coupling element on the end which mates with the bullet end component and a male coupling element on the end which mates with the head end component.
Figure 1B:
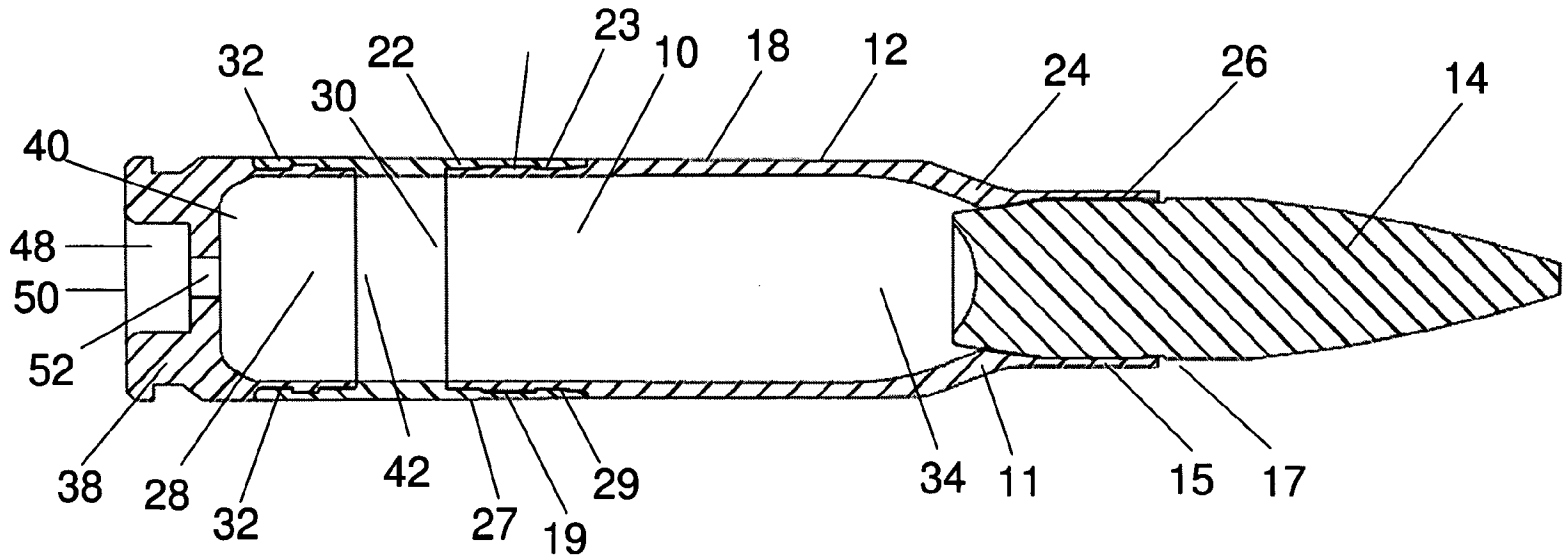
FIG. 1*b* depicts a side, cross-sectional view of a polymeric cartridge case according to a third embodiment of the present invention in which the middle body component has a female coupling element on the end which mates with the bullet end component and a female coupling element on the end which mates with the head end component.
Figure 1C:
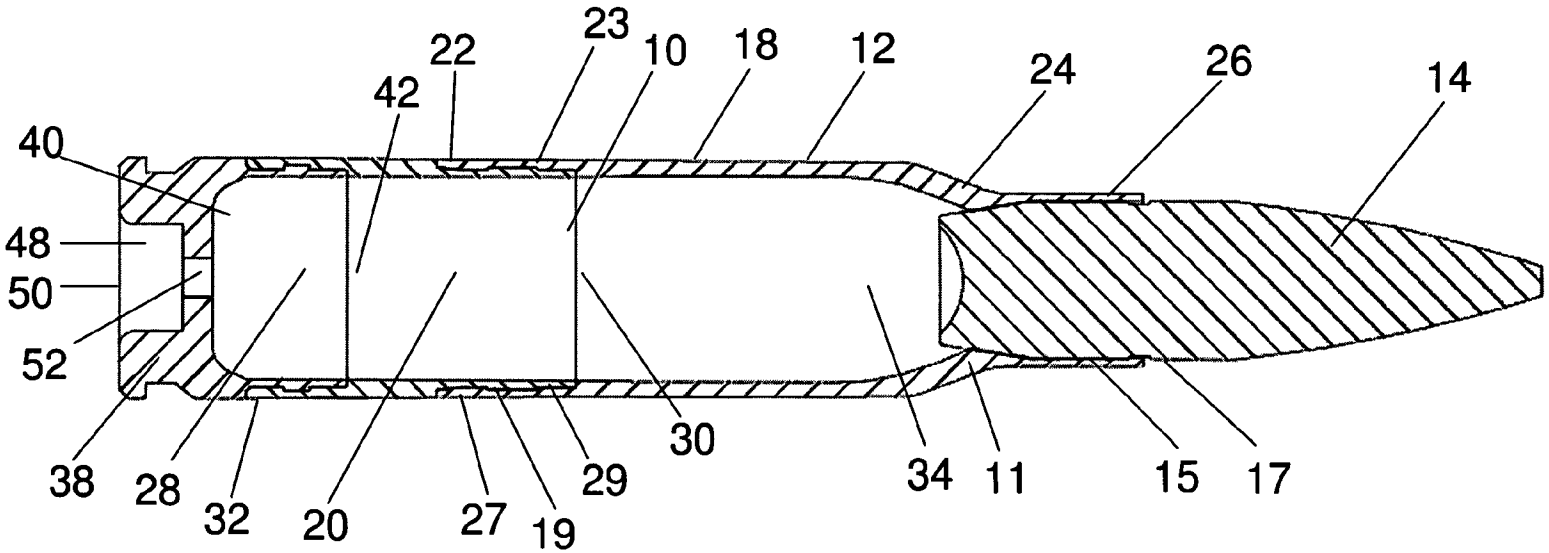
FIG. 1*c* depicts a side, cross-sectional view of a polymeric cartridge case according to a fourth embodiment of the present invention in which the middle body component has a male coupling element on the end which mates with the bullet end component and a female coupling element on the end which mates with the head end component.

In alternate embodiments, shown in FIGS. 1*a* and 1*c*, coupling element 22 of bullet end component 18 may be configured as the female element, while coupling element 30, formed on the first end of middle body component 28, can be configured as the male element.

The interlock surface 19 of male coupling element 22 is preferably straight with a taper to a smaller diameter at the forward tip, while the deformable skirt 21 of female coupling element 30 is preferably straight with a taper to a smaller diameter at the skirt tip 29 at the first end of middle body component 28. When contacted with the interlock surface 19 of male coupling element 22, a physical interlock results between bullet-end component 18 and middle body component 28. The bullet-end and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature (estimated above 300° F.). An optional annular groove may be provided in the deformable skirt of the female coupling element opposite an optional annular ring in the interlock surface of the male coupling element to provide a snap-fit between the two components.

The bullet-end, middle body and head-end components 18, 28 and 38 define the interior of powder chamber 34 in which the powder charge (not shown) is contained. The interior volume of powder chamber 34 may be varied to provide the volume necessary for complete filling of the chamber 34 by the propellant chosen so that a simplified volumetric measure of propellant can be utilized when loading the cartridge. Either a particulate or consolidated propellant can be used.

Figure 4:
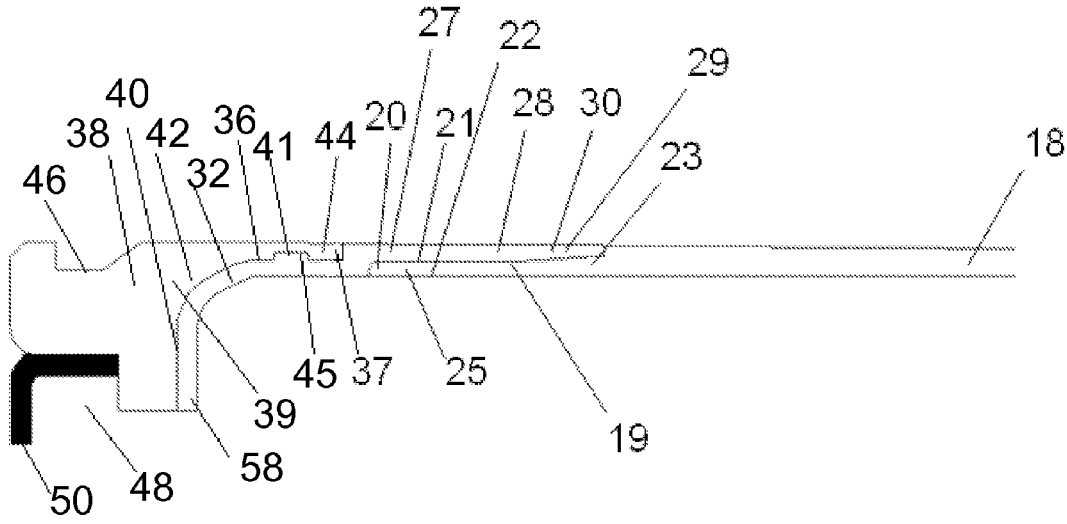
FIG. 4 is a partial cross-sectional view of the polymeric cartridge casing of FIG. 2.

Referring to FIG. 4, the casing and powder chamber are closed by cylindrical cartridge casing head-end component 38 having a closed base end 40 opposite an open end with a female coupling element 42. In the depicted embodiment the head-end component 38 is steel or brass and is formed in a high pressure forming apparatus as is well known in the prior art. However, the die used provides for an annular groove 41 and a diverging deformable skirt 44 on female coupling element 42 having a larger diameter at the skirt base 39 and a relatively smaller diameter at the skirt tip 37.

The head-end component may also be formed from high-strength polymer, composite or ceramic. Examples of suitable high strength polymers include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components with wall thicknesses as thin as about 0.010 inches. Composite components can also be formed by machining.

As shown in FIGS. 1 and 1*a*, coupling element 32 at the second end of middle body component 28 is configured as a male element and is formed with an interlock surface 36 with annular ring 45 adapted to mate and interlock with the annular groove 41 on deformable skirt 44 on coupling element 42 at the open end of head-end component 38, which is configured as a female element. The interlock surface 36 of coupling element 32 also preferably tapers from a larger diameter at the rearward most portion thereof to a smaller diameter at the forward portion, while the thickness of skirt 44 also increases from skirt base 39 to skirt tip 37 so that when contacted with the interlock surface 36 of coupling element 32, a physical snap-fit or molded-in mechanical interlock results between head-end component 38 and middle body component 28.

In alternate embodiments, shown in FIGS. 1*b* and 1*c*, coupling element 32 formed on the second end of middle body component 28 may be configured as a female element and coupling element 42, formed on the open end of casing head-end component 28 may be configured as a male element. Thus, middle body component 38 can have male coupling elements on both ends, female coupling elements on both ends, or a male coupling element on one end and a female coupling element on the opposite end.

Head-end component 38 also has an extraction groove 46 cut therein and a primer recess 48 formed therein for ease of insertion of the primer 50. The primer recess 48 is sized so as to receive the primer 50 in an interference fit during assembly. A primer flash hole 52 communicates through the base end 40 of head-end component 38 into the powder chamber 34 so that upon detonation of primer 50 the powder in powder chamber 34 will be ignited.

Projectile 14 is held in place within chamber case neck 26 at forward opening 16 by an interference fit. Mechanical crimping of the case mouth 17 can also be applied to increase the bullet pull force. The bullet may be inserted into place following the completion of the filling of powder chamber 34. Projectile 14 can also be injection molded directly onto the bullet-end component prior to welding or bonding the bullet-end and middle body components together, when the consolidated powder is used.

The polymeric ammunition cartridges of the present invention are of a caliber typically carried by soldiers in combat for use in their combat weapons. This includes various small and medium caliber munitions, including 5.56 mm, 7.62 mm and 0.50 caliber ammunition cartridges, as well as medium caliber ammunition such as 20 mm, 25 mm, 30 mm, 40 mm, and the like. The cartridges, therefore, are of a caliber between about 0.197 and about 3.937 inches (i.e., between about 5 and about 100 mm). Thus, the present invention is also applicable to the sporting goods industry for use by hunters and target shooters.

Figure 2:
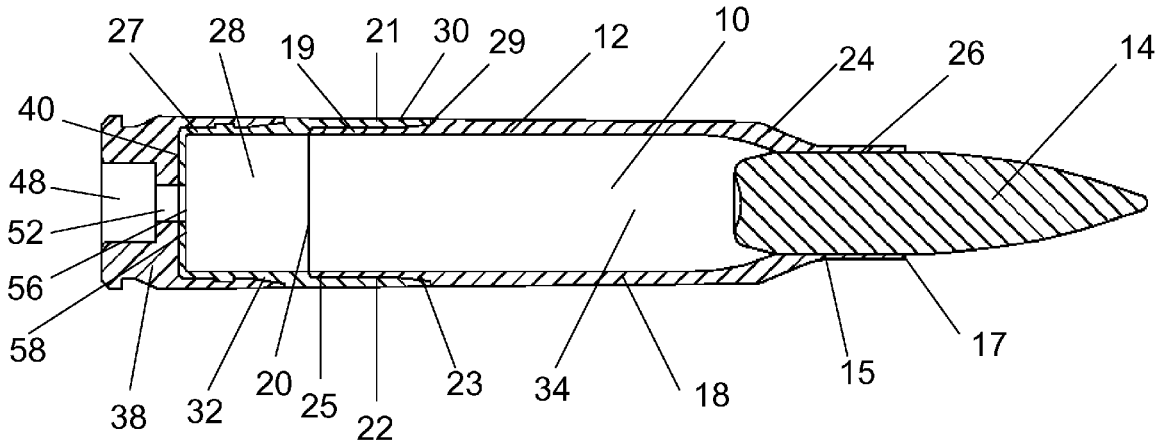
FIG. 2 depicts a side, cross-sectional view of a polymeric cartridge case according to another embodiment of the present invention.

An alternate embodiment for use with aluminum head-end components is depicted in FIGS. 2 and 4. Despite being lightweight, head-end components have not been formed from aluminum because of problems with case burn-through when aluminum case exposes to high temperature propellant gases upon primer detonation. FIGS. 2 and 4 depict a cartridge casing with an aluminum head-end component 38 in which the second end of middle body component 28 has a closed base end 58 so that there is no direct exposure of aluminum to propellant gas, even in situations when a crack is generated in the aluminum head-end component. Base end 58 has a primer flash hole 56 through which the powder in powder chamber 34 will be ignited upon detonation of primer 50. The prevention of burn-through permits the use of aluminum in the fabrication of the head-end component, thereby further reducing the weight of the ammunition cartridge.

The aluminum head-end component is preferably fabricated from high-strength 7075 aluminum to provide resistance to ballistic pressure for unsupported areas. The closed base end 58 can be fabricated from a high strength glass fiber filled plastic composite or a ductile unfilled polymer that is directly injection molded or snap-fit onto the aluminum head end component.

This three-piece design can achieve a high pull strength resistance, and thus overcomes the case separation problems consistently seen in two-piece metal-polymer designs, particularly at the hot gun chamber (can be above 320 F) after firing hundreds of rounds of ammunition. Case separation during extraction can cause the polymer case body to stay in the gun chamber and jam the weapon when a new cartridge is loaded into the chamber and cause weapon damage or personnel injuries.

Figure 6A:
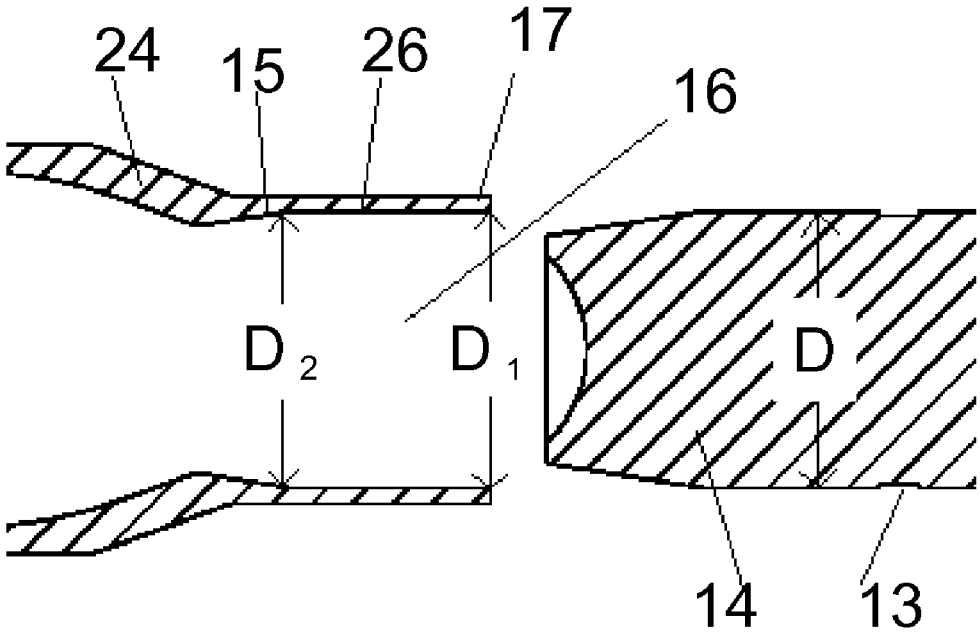
FIG. 6*a* depicts a side, cross-sectional view of a polymeric cartridge case neck and a projectile to be seated therein according to another embodiment of the present invention.
Figure 6B:
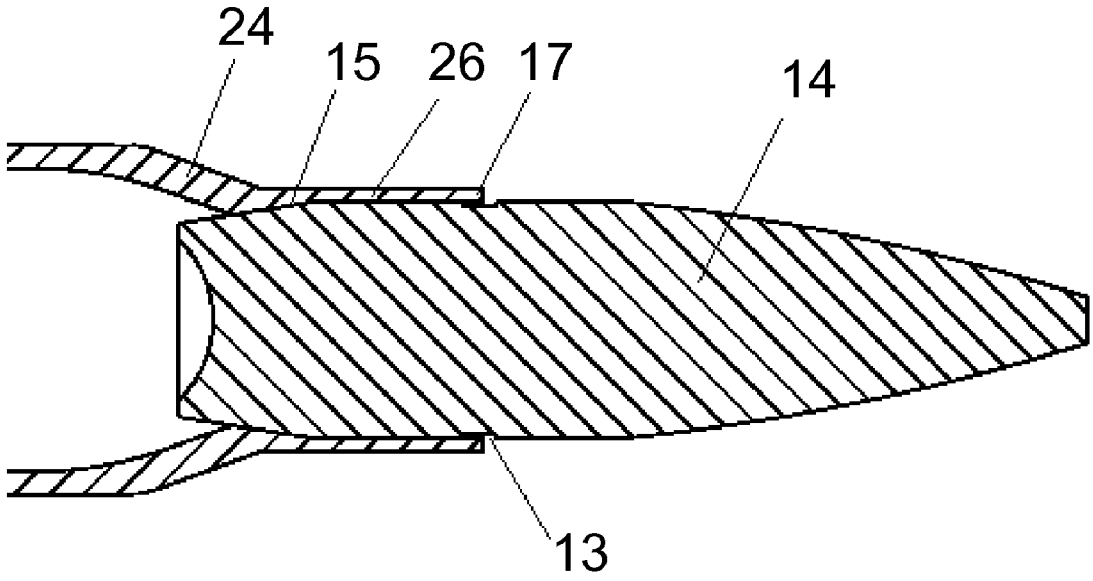
FIG. 6*b* depicts a side, cross sectional view of a projectile seated in the polymer cartridge case neck of FIG. 6*a*.

While described with reference to aluminum casing head-end components, the three-piece design can be employed with essentially any casing head-end material. Likewise, regardless of the casing head-end material used, several embodiments are provided for holding the projectile in place in the bullet-end component and preventing the bullet from being pushed into the powder chamber during the cartridge assembly process. FIGS. 6*a* and 6*b* depict a casing embodiment according to the present invention wherein the projectile body does not extend beyond the base of the case neck. Thickened shoulder 24 forming chamber neck 26 at the forward end of bullet-end component 18 is dimensioned so that forward end opening 16 tapers from a larger inner diameter $D_1$ at the tip of the casing mouth 17 to a narrower inner diameter $D_2$ at the base 15 of shoulder 24.

In the embodiment depicted in FIGS. 6*a* and 6*b*, projectile 14 has an annular groove 13 positioned to receive the tip of casing mouth 17 to increase the frictional resistance of the interference fit between projectile 14 and casing neck 26. The casing mouth can be crimped at the tip to increase further the frictional resistance. Crimping the case mouth 17 with or without heat can force polymeric material to flow into the annular grove 13 of the projectile, thus increasing the bullet pull force. The inner diameter $D_1$ should be not more 0.002 inches larger than the largest diameter D of projectile 14, but not more than 0.008 inches smaller than projectile diameter D, and preferably the same size or smaller than the largest diameter D of the projectile. Inner diameter $D_2$ should be between about 0.002 and about 0.025 inches smaller than projectile diameter D, preferably between about 0.006 and about 0.012 inches smaller, and even more preferably between about 0.006 and 0.008 inches smaller.

Figure 5A:
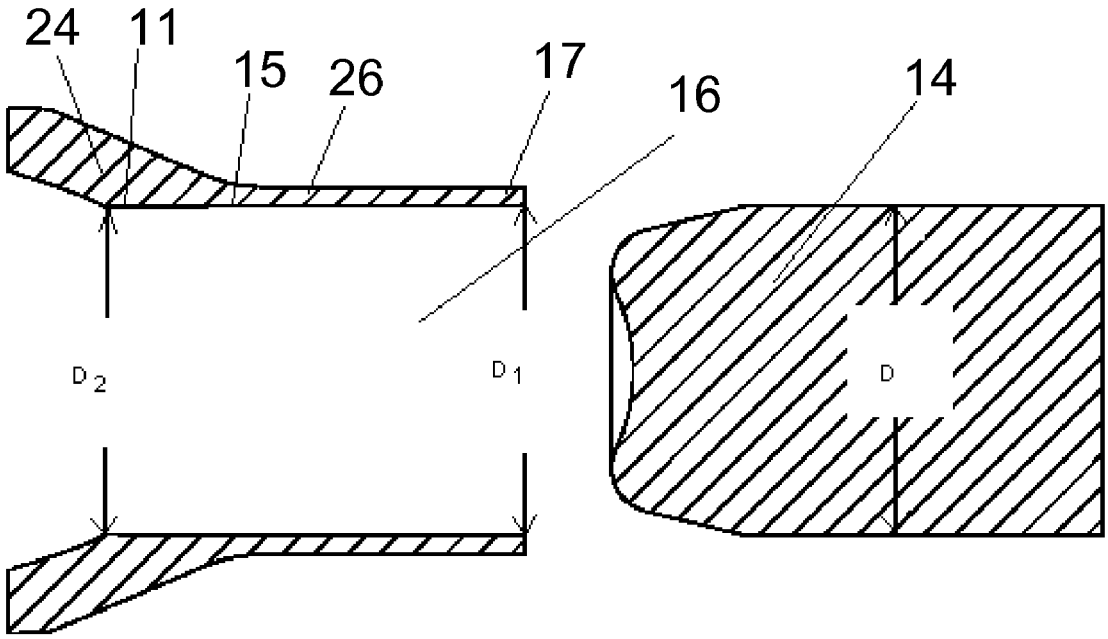
FIG. 5*a* depicts a side, cross-sectional view of a polymeric cartridge case neck and a projectile to be seated therein according to one embodiment of the present invention.
Figure 5B:
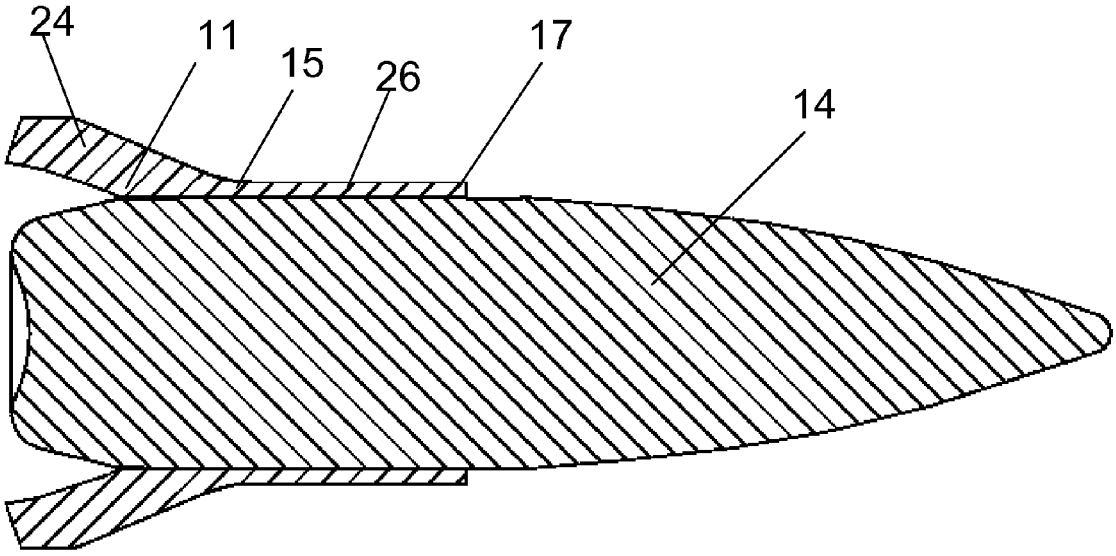
FIG. 5*b* depicts a side, cross sectional view of a projectile seated in the polymer cartridge case neck of FIG. 5*a;*

FIGS. 5*a* and 5*b* depict a casing embodiment according to the present invention in which the projectile body extends beyond the base of the case neck. Thickened shoulder 24 forming neck 26 at the forward end of bullet-end component 18 is dimensioned so that forward end opening 16 tapers from larger inner diameter $D_1$ at the tip of the casing mouth 17, beyond the base 15 of thickened shoulder 24 to a narrower inner diameter $D_2$ at the base 11 of neck 26. Inner diameter $D_1$ should be less than 0.002 inches larger than the largest diameter D of projectile 14, but not less than 0.008 inches of projectile diameter D. Inner diameter $D_2$ should also be between about 0.002 and about 0.025 inches smaller than the projectile diameter D, preferably between about 0.006 and bout 0.012 inches smaller, and even more preferably between about 0.006 and 0.008 inches smaller.

Figure 7A:
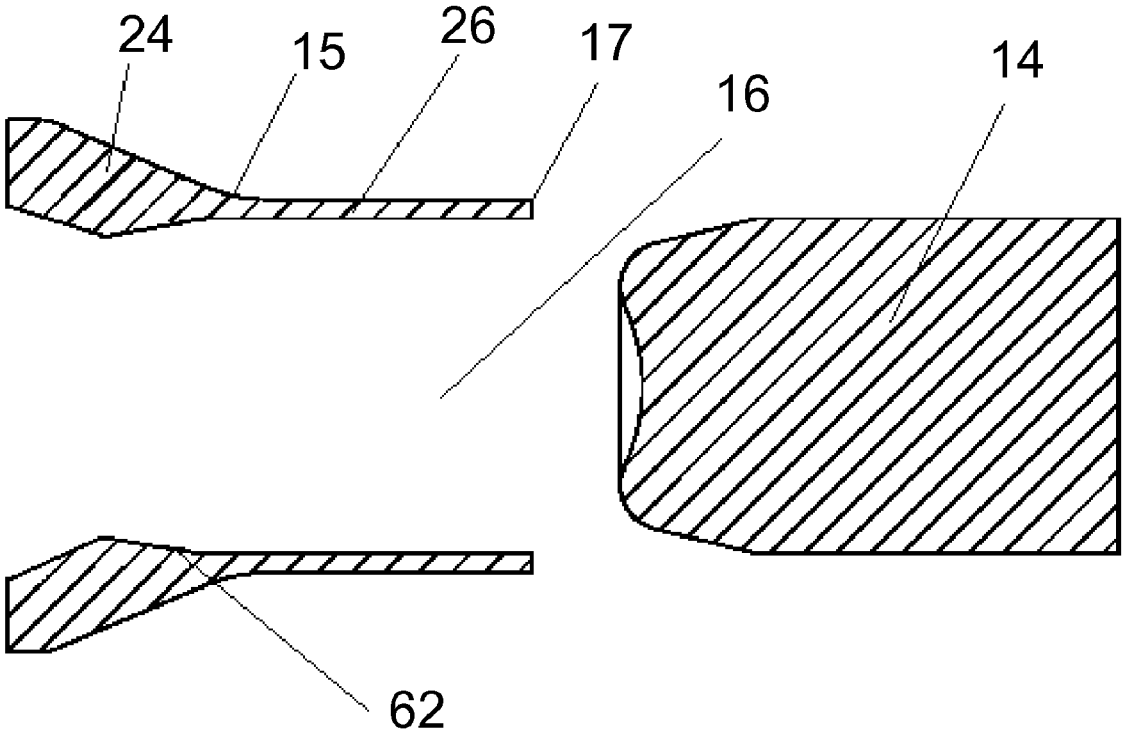
FIGS. 7*a* and 7*d* depict side, cross-sectional views of polymeric cartridge case necks according to two other embodiments of the invention.
Figure 7B:
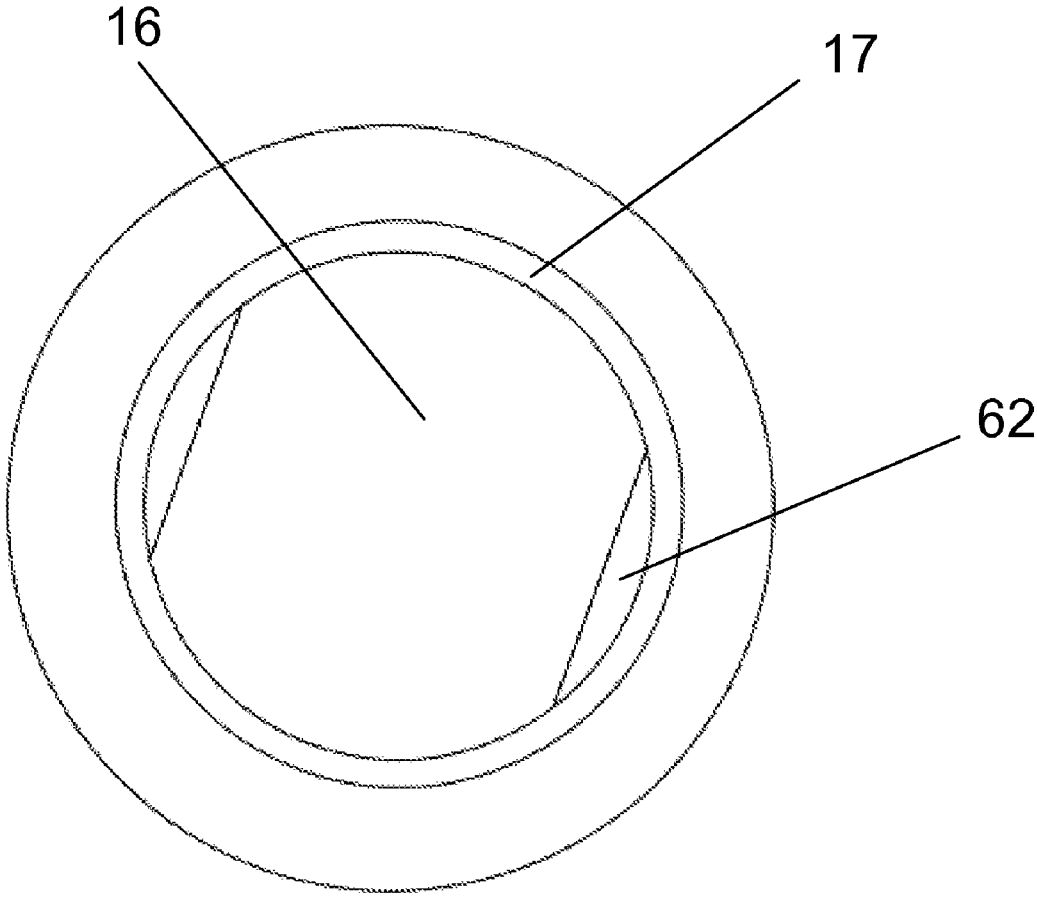
FIGS. 7*b* and 7*c* depict top views of two other embodiments of polymeric cartridge case necks according to the present invention.
Figure 7C:
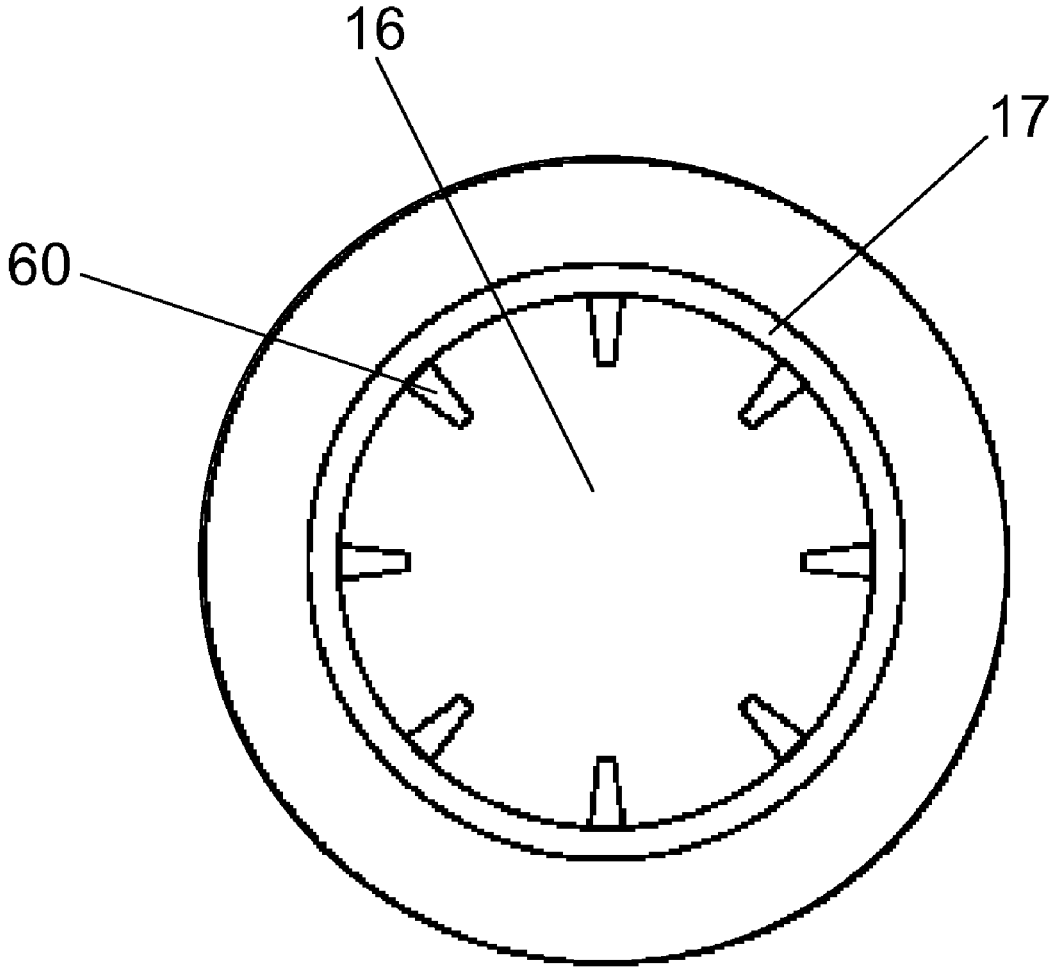

FIG. 7*a* depicts a casing embodiment according to the present invention in which the neck 26 at the forward end of bullet-end component 18 is molded with an internal recess or shoulder 62 along the entire inner circumference of the neck, which is adapted to receive and hold in place the projectile 14. As shown in FIGS. 7*b* and 7*c*, the internal support need not be a continuous shoulder or recess around the interior circumference of the neck 26 of bullet-end component 18.

Figure 7D:
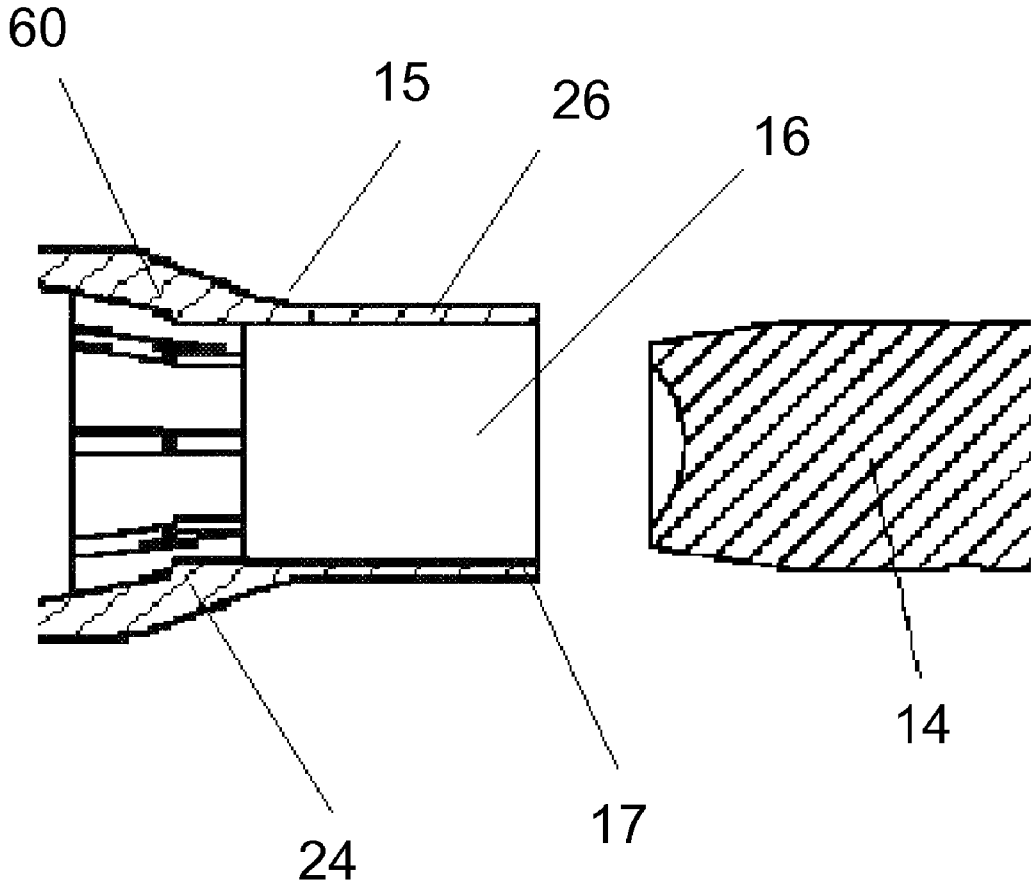

As shown in FIGS. 7*c* and 7*d*, the ductile polymer of a bullet-end component can be molded with a plurality of internal ribs 60 for supporting projectile 14 and holding it in place. From 3 to 12 ribs can be used having a thickness between about 0.010 and about 0.100 inches and preferably between about 0.020 and about 0.040 inches. The ribs are particularly useful in combination with projectiles having "boat-tail" ends, and extend in FIG. 7*c* from the interior wall of the neck of the bullet end component to the smaller projectile diameter at the tip of the boat-tail.

Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH). Finally, the cartridge case must retain sufficient joint strength at cook-off temperatures. More specifically, polymers suitable for molding of the projectile-end component have one or more of the following properties:

Yield or tensile strength at −65° F.>10,000 psi

Elongation-to-break at −65° F.>15%

Yield or tensile strength at 73° F.>8,000 psi

Elongation-to-break at 73° F.>50%

Yield or tensile strength at 320° F.>4,000 psi

Elongation-to-break at 320° F.>80%

The elongation-to-break values of the ductile polymers used for the bullet-end components of the present invention range as high as about 60% to 140% at 73° F. The high polymer ductility permits the casing to resist breakage.

Polymers suitable for molding of the middle-body component have one or more of the following properties:

Yield or tensile strength at −65° F.>10,000 psi

Yield or tensile strength at 73° F.>8,000 psi

Yield or tensile strength at 320° F.>4,000 psi

Preferred polymers for use in the present invention meet all of the foregoing properties. Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(ether-imide-siloxane) copolymers; and the like.

Particularly preferred are polyphenylsulfones and their copolymers with poly-sulfones or polysiloxane that have high tensile strength and elongation-to-break to sustain the deformation under high interior ballistic pressure. Such polymers are commercially available, for example, Radel® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The foregoing polymers can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body.

Ammunition cartridge casings according to one embodiment of the present invention have a headspace length larger than the corresponding head-space length of the chamber of the intended weapon, measured at the same basic diameter for the cartridge casing, without being so large as to jam the weapon or otherwise interfere with its action. The mechanical properties of plastic compared to brass permit the use of such a design, permitting the weapon's bolt to compress cartridge casing slightly to close the firing chamber.

The use of a larger headspace length overcomes the difficulties with ejecting prior art polymeric cartridge casings from weapon chambers after firing, which tend to jam in the chamber. Cartridge headspace length according to the present invention should be between about 0.001 and about 0.030 inches larger than the corresponding chamber headspace length, and preferably between about 0.002 and about 0.08 inches larger.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The casing components are otherwise formed and assembled by essentially conventional polymer fabrication methods. Typically, the polymeric and composite components are injection molded. According to one embodiment, the middle body component is either molded onto or snap-fit to the casing head-end component after which the bullet-end component is snap-fit or interference fit to the middle body component.

The cartridge casing is then filled with a propellant and joined to a projectile. This can be done in line or at a remote location without modification using conventional equipment for manufacturing brass ammunition cartridges. The projectile can also be injection molded directly onto the bullet-end component prior to welding or bonding the bullet-end and middle body component together, when consolidated powder is used.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

What is claimed is:

1. An ammunition cartridge comprising:

(1) a substantially cylindrical polymeric cartridge casing body defining a casing headspace, with an open projectile-end for receiving a projectile and an end opposing the projectile-end, said casing body comprising:

(A) a substantially cylindrical injection molded polymeric bullet-end component with opposing first and second ends, the first end of which is the projectile-end of the casing body and the second end comprises a male or female coupling element; and (B) a cylindrical polymeric middle body component with opposing first and second ends, wherein said first end comprises a coupling element that is a mate for said projectile-end coupling element joining said first end of said middle body component to said second end of said bullet-end component, and wherein said second end of said middle body component is said end of said casing body opposite said projectile end, said second end of said middle body component comprising a male or female coupling element;

(2) a cylindrical cartridge casing head-end component comprising an essentially closed base end with a primer hole opposite an open end comprising a coupling element that is a mate for said coupling element on said second end of said middle body component joining said open end of said head-end component to said second end of said middle body component;

wherein said projectile-end of said bullet-end component comprises an opening having an inner diameter in which any one point has a smaller diameter than the diameter of said projectile;

wherein said middle body component is formed from a material that is more ductile than the material from which said head-end component is formed but equal to or less than the ductility of the material from which said bullet-end component is formed; and wherein said polymeric bullet-end component is formed from a polymer having all of the following properties:
Yield or tensile strength at −65° F.>10,000 psi
Elongation-to-break at −65° F.>15%
Yield or tensile strength at 73° F.>8,000 psi
Elongation-to-break at 73° F.>50%
Yield or tensile strength at 320° F.>4,000 psi
Elongation-to-break at 320° F.>80%; and wherein said polymeric middle body component is formed from a polymer having all of the following properties:
Yield or tensile strength at −65° F.>10,000 psi
Yield or tensile strength at 73° F.>8,000 psi
Yield or tensile strength at 320° F.>4,000 psi.

2. The ammunition cartridge of claim 1, wherein either or both of said bullet-end component and said middle body component is formed from a ductile polymer.

3. The ammunition cartridge of claim 2, wherein said middle body component is formed from a fiber-reinforced polymeric composite.

4. The ammunition cartridge of claim 3, wherein said fiber-reinforced polymeric composite contains between about 10 and about 70 wt % glass fiber fillers, mineral fillers, or mixtures thereof.

5. The ammunition cartridge of claim 1, wherein said bullet-end component and said middle body component are formed from the same polymer.

6. The ammunition cartridge of claim 1, wherein said bullet-end component and said middle body component are formed from different polymers.

7. The ammunition cartridge of claim 1, wherein one coupling element on said middle body component is a male coupling element and the other is a female coupling element.

8. The ammunition cartridge of claim 7, wherein said first end of said middle body component comprises a female coupling element and said second end of said bullet-end component comprises a male coupling element dimensioned to snap-fit or interference fit within and engage said female coupling element of said middle body component, and said second end of said middle body component comprises a male coupling element and said open end of said head-end component comprises a female coupling element and said male coupling element of said middle body component is dimensioned to snap-fit or interference fit within and engage said female coupling element of said head-end component.

9. The ammunition cartridge of claim 8, wherein said male coupling element of said bullet-end component and said female coupling element of said middle body component are further welded or bonded together.

10. The ammunition cartridge of claim 8, wherein said head-end component is formed from aluminum, said middle body component is formed from a fiber-reinforced polymer composite and the second end of said middle body component comprises an essentially closed base end with a primer flash hole.

11. The ammunition cartridge of claim 8, wherein said female coupling element of said head-end component is formed with a straight skirt interlock surface with at least one annular groove and said male coupling element of said middle body component is formed with a straight interlock surface with at least one annular ring dimensioned to fit within and engage an annular groove of said female coupling element of said head-end component to provide a fit or snap-fit or interference fit or mechanical interlock engagement between the two components.

12. The ammunition cartridge of claim 8, wherein said female coupling element of said middle body component is formed with a tapered skirt end and a straight interlock surface with at least one annular groove and said male coupling element of said bullet-end component is formed with a tapered end and a straight interlock surface with at least one annular ring dimensioned to fit within and engage an annular groove of said female coupling element of said middle body component to provide a snap-fit interlock engagement between the two components.

13. The ammunition cartridge of claim 8, wherein said male coupling element of said bullet-end component is formed with a straight interlock surface that tapers to a smaller diameter at the coupling element tip, and said female coupling element of said middle body component is formed with a straight interlock surface that tapers to a smaller diameter at the forward portion on the skirt tip.

14. The ammunition cartridge of claim 13, wherein said tapered skirt interlock surface of said female coupling element of said middle body component is formed with at least one annular groove and said interlock surface of said male coupling element of said bullet-end component is formed with at least one annular ring dimensioned to fit within and engage an annular groove of said female coupling element to provide a snap-fit interlock engagement between the two components.

15. The ammunition cartridge of claim 8, wherein said inner diameter of said female coupling element of said middle body component is equal or smaller than the outer diameter of said male coupling element of said bullet-end component.

16. The ammunition cartridge of claim 8, wherein said male coupling element of said middle body component is formed with a straight interlock surface that tapers to a smaller diameter at the coupling element tip, and said female coupling element of said head-end component is formed with a straight skirt interlock surface that tapers to a smaller diameter at the forward portion on the skirt tip.

17. The ammunition cartridge of claim 16, wherein said tapered skirt interlock surface of said female coupling element of said head-end component is formed with at least one annular groove and said interlock surface of said male coupling element of said middle body component is formed with at least one annular ring dimensioned to fit or snap-fit within and engage an annular groove of said female coupling element to provide a fit or snap-fit or interference fit or mechanical interlock engagement between the two components.

18. The ammunition cartridge of claim 1, wherein said bullet-end component and said middle body component comprise the same or different polymers selected from the group consisting of polyphenylsulfones; copolymers of polyphenylsulfones with polyethersulfones or polysulfones; copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

19. The ammunition cartridge of claim 1, wherein said head-end component is formed from high strength polymer, fiber-reinforced polymer composite, ceramic or metal.

20. The ammunition cartridge of claim 19, wherein said head-end component is formed from a metal selected from the group consisting of aluminum, steel and brass.

21. The ammunition cartridge of claim 1, wherein said head-end component is formed from steel or brass, said middle body component is formed from a fiber-reinforced polymer composite or a ductile polymer and the second end of said middle body component comprises an essentially closed base end with a primer flash hole.

22. The ammunition cartridge of claim 10 or claim 21, wherein said middle body component is injection molded into said head-end component.

23. The ammunition cartridge of claim 10 or claim 21, wherein said middle body component is snap-fit into said head-end component.

24. The ammunition cartridge of claim 10 or claim 21, wherein said bullet-end component is formed from a ductile polymer that is welded or bonded to said middle body component.

25. The ammunition cartridge of claim 1, wherein said bullet-end, middle body and head-end component define the interior of a powder chamber.

26. The ammunition cartridge of claim 25, wherein said projectile end opening has an inner diameter no more than 0.002 inches larger than but no more than 0.008 inches smaller than said projectile diameter.

27. The ammunition cartridge of claim 26, wherein said casing neck interior tapers to an inner diameter at the base of said casing neck between about 0.002 and about 0.025 inches smaller than said projectile diameter.

28. The ammunition cartridge of claim 27, wherein said neck comprises a plurality of internal structures for supporting a projectile.

29. The ammunition cartridge of claim 28, wherein said bullet-end component is molded with a plurality of internal ribs affixed to said neck for supporting a projectile.

30. The ammunition cartridge of claim 27, wherein said neck defines an annular inner recess for supporting a projectile.

31. The ammunition cartridge of claim 27, further comprising a particulate or consolidated propellant charge in said powder chamber and a projectile inserted into said casing beyond the base of said casing neck.

32. The ammunition cartridge of claim 31, wherein said projectile has an annular groove positioned to receive the tip of said casing mouth.

33. The ammunition cartridge of claim 32, wherein said casing mouth is crimped at said tip so that polymeric material at said tip flows into said annular groove of said projectile.

34. The ammunition cartridge of claim 31, wherein said casing neck interior tapers to an inner diameter at the base of said casing neck between about 0.002 and about 0.025 inches smaller than said projectile diameter.

35. The ammunition cartridge of claim 25, wherein the inner diameter of said bullet-end component narrows within said casing neck to form an interior shoulder supporting said casing neck and said casing neck interior tapers to an inner diameter at said shoulder between about 0.002 and about 0.025 inches smaller than said projectile diameter.

36. The ammunition cartridge of claim 35, wherein said neck and shoulder define an annular inner recess for supporting a projectile.

37. The ammunition cartridge of claim 35, further comprising a particulate or consolidated propellant charge in said powder chamber and a projectile inserted into said casing to the base of said casing neck.

38. The ammunition cartridge of claim 37, wherein said projectile has an annular groove positioned to receive the tip of said casing opening.

39. The ammunition cartridge of claim 38, wherein said casing opening is crimped at said tip so that polymeric material at said tip flows into said annular groove of said projectile.

40. The ammunition cartridge of claim 25, wherein said neck and shoulder comprise a plurality of internal structures for supporting a projectile.

41. The ammunition cartridge of claim 25, wherein said bullet-end component is molded with a plurality of internal ribs affixed to said neck and shoulder for supporting a projectile.

42. The ammunition cartridge of claim 1, wherein both coupling elements on said middle body component are male coupling elements.

43. The ammunition cartridge of claim 1, wherein both coupling elements on said middle body component are female coupling elements.

44. The ammunition cartridge of claim 1, wherein one end of said middle body component defines a male coupling element and the opposite end defines a female coupling element.

45. In combination, an ammunition cartridge and a weapon for firing said ammunition cartridge said ammunition cartridge comprising:

(1) a substantially cylindrical polymeric cartridge casing body defining a casing headspace, with an open projectile-end for receiving a projectile and an end opposing the projectile-end, said casing body comprising:

(A) a substantially cylindrical injection molded polymeric bullet-end component with opposing first and second ends, the first end of which is the projectile-end of the casing body and the second end comprises a male or female coupling element; and (B) a cylindrical polymeric middle body component with opposing first and second ends, wherein said first end comprises a coupling element that is a mate for said projectile-end coupling element joining said first end of said middle body component to said second end of said bullet-end component, and wherein said second end of said middle body component is said end of said casing body opposite said projectile end, said second end of said middle body component comprising a male or female coupling element;

(2) a cylindrical cartridge casing head-end component comprising an essentially closed base end with a primer hole opposite an open end comprising a coupling element that is a mate for said coupling element on said second end of said middle body component joining said open end of said head-end component to said second end of said middle body component;

wherein said bullet-end component comprises a neck from the case shoulder of the cartridge to the opening at said projectile end and said neck has an inner diameter in which any one point has a smaller diameter than the diameter of said projectile, and wherein said middle body component is formed from a material that is more ductile than the material from which said head-end component is formed but equal to or less than the ductility of the material from which said bullet-end component is formed;

wherein said weapon comprises a chamber having a headspace dimension for said cartridge into which said cartridge is inserted, and said casing has a headspace dimension larger than said headspace dimension of said weapon chamber measured at 73° F., without being so large as to jam the weapon or otherwise interfere with its action; and wherein said casing headspace dimension is between about 0.001 and about 0.030 inches larger than said corresponding headspace dimension of said weapon chamber.

46. An ammunition cartridge comprising:

(1) a one-piece substantially cylindrical polymeric cartridge casing body defining a casing headspace, with an open projectile-end and an end opposing the projectile-end with a male or female coupling element; and (2) a cylindrical metal cartridge casing head-end component comprising an essentially closed base end with a primer hole opposite an open end comprising a male or female coupling element that is a mate for said coupling element on said opposing end of said polymeric cartridge casing body joining said open end of said head-end component to said to said opposing end of said polymeric cartridge casing body;

wherein said polymeric cartridge casing body is formed from a polymer having all of the following properties:

Yield or tensile strength at −65° F.>10,000 psi

Elongation-to-break at −65° F.>15%

Yield or tensile strength at 73° F.>8,000 psi

Elongation-to-break at 73° F.>50%

Yield or tensile strength at 320° F.>4,000 psi

Elongation-to-break at 320° F.>80%.

47. The ammunition cartridge of claim 46, wherein said polymer is selected from the group consisting of polyphenylsulfones, copolymers of polyphenylsulfones with polyethersulfones or polysulfones, copolymers of polyphenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

48. The ammunition cartridge of claim 46, wherein said one-piece substantially cylindrical polymeric cartridge casing body and said cylindrical metal cartridge casing head-end component define a shotgun shell.

49. In combination: the ammunition cartridge of claim 46 and a weapon for firing said ammunition cartridge, wherein said weapon comprises a chamber having a headspace dimension for said cartridge into which said cartridge is inserted, and said casing has a headspace dimension larger than said headspace dimension of said weapon—chamber measured at 73° F., without being so large as to jam the weapon or otherwise interfere with its action.

50. The ammunition cartridge of claim 49, wherein said casing headspace dimension is between about 0.001 and about 0.030 inches larger than said corresponding headspace dimension of said weapon chamber.

51. An ammunition cartridge comprising:

(1) a one-piece substantially cylindrical polymeric cartridge casing body defining a casing headspace, with an open projectile-end and an end opposing the projectile-end with a coupling element; and (2) a cylindrical metal cartridge casing head-end component comprising an essentially closed base end with a primer hole opposite an open end comprising a coupling element that is a mate for said coupling element on said opposing end of said polymeric cartridge casing body for joining said open end of said head-end component to said opposing end of said polymeric cartridge casing body;

wherein said open projectile-end of said cartridge casing body comprises an opening having an inner diameter in which any one point has a smaller diameter than the projectile; and wherein said polymeric cartridge casing body is formed from a polymer having all of the following properties:

Yield or tensile strength at −65° F.>10,000 psi

Elongation-to-break at −65° F.>15%

Yield or tensile strength at 73° F.>8,000 psi

Elongation-to-break at 73° F.>50%

Yield or tensile strength at 320° F.>4,000 psi

Elongation-to-break at 320° F.>80%.

52. The ammunition cartridge of claim 51, wherein said polymer is selected from the group consisting of polyphenylsulfones, copolymers of polyphenylsulfones with polyethersulfones or polysulfones, copolymers of polyphenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

53. The ammunition cartridge of claim 51, wherein said one-piece substantially cylindrical polymeric cartridge casing body and said cylindrical metal cartridge casing head-end component define a shotgun shell.

54. In combination, an ammunition cartridge and a weapon for firing said ammunition cartridge, said ammunition cartridge comprising:

(1) a one-piece substantially cylindrical polymeric cartridge casing body defining a casing headspace, with an open projectile-end and an end opposing the projectile-end with a coupling element; and (2) a cylindrical metal cartridge casing head-end component comprising an essentially closed base end with a primer hole opposite an open end comprising a coupling element that is a mate for said coupling element on said opposing end of said polymeric cartridge casing body for joining said open end of said head-end component to said opposing end of said polymeric cartridge casing body;

wherein said bullet-end component comprises a neck from the case shoulder of the cartridge to the opening at said projectile end and said neck has an inner diameter in which any one point has a smaller diameter than the projectile; and wherein said weapon comprises a chamber having a headspace dimension for said cartridge into which said cartridge is inserted, and the casing has a headspace dimension larger than said headspace dimension of said weapon chamber measured at 73° F., without being so large as to jam the weapon or otherwise interfere with its action.

55. The ammunition cartridge of claim 54, wherein said casing headspace dimension is between about 0.001 and about 0.030 inches larger than said corresponding headspace dimension of the intended weapon chamber.

56. In combination:

(1) an ammunition cartridge comprising:

(a) a substantially cylindrical polymeric cartridge casing body comprising a headspace dimension, with an open projectile-end and an end opposing the projectile-end, said casing body comprising:

(i) a substantially cylindrical injection molded polymeric bullet-end component with opposing first and second ends, the first end of which is the projectile-end of the casing body and the second end comprises a coupling element; and (ii) a cylindrical polymeric middle body component with opposing first and second ends, wherein said first end comprises a coupling element that is a mate for said projectile-end coupling element joining said first end of said middle body component to said second end of said bullet-end component, and said second end is said end of said casing body opposite said projectile end and comprises a coupling element; and (b) a cylindrical cartridge casing head-end component comprising an essentially closed base end with a primer hole opposite an open end comprising a coupling element that is a mate for said coupling element on said second end of said middle body component joining said open end of said head-end component to said second end of said middle body component;

wherein said middle body component is formed from a material that is more ductile than the material from which said head-end component is formed but equal to or less than the ductility of the material from which said bullet-end component is formed; said bullet-end component is formed from a polymer having one or more of the following mechanical properties:

Yield or tensile strength at −65° F.>10,000 psi

Elongation-to-break at −65° F.>15%

Yield or tensile strength at 73° F.>8,000 psi

Elongation-to-break at 73° F.>50%

Yield or tensile strength at 320° F.>4,000 psi

Elongation-to-break at 320° F.>80%;

and said middle body component is formed from a polymer having one or more of the following mechanical properties:

Yield or tensile strength at −65° F.>10,000 psi

Yield or tensile strength at 73° F.>8,000 psi and

Yield or tensile strength at 320° F.>4,000 psi; and (2) a weapon for firing said ammunition cartridge, wherein said weapon comprises a chamber having a headspace dimension for said cartridge into which said cartridge is inserted, and said casing headspace dimension is larger than the corresponding headspace dimension of said weapon chamber measured at 73° F. without being so large as to jam the weapon or otherwise interfere with its action.

57. The combination of claim 56, wherein said polymer is selected from the group consisting of polyphenylsulfones, copolymers of polyphenylsulfones with polyether-sulfones or polysulfones, copolymers of polyphenylsulfones with siloxanes, blends of poly-phenylsulfones with polysiloxanes, poly(etherimide-siloxane) copolymers, blends of polyetherimides and polysiloxanes, and blends of polyetherimides and poly(etherimide-siloxane) copolymers.

* * * * *

UNITED STATES PATENT AND TRADEMARK OFFICE

CERTIFICATE OF CORRECTION

PATENT NO. : 7,610,858 B2
APPLICATION NO. : 11/560726
DATED : November 3, 2009
INVENTOR(S) : Sengshiu Chung It is certified that error appears in the above-identified patent and that said Letters Patent is hereby corrected as shown below:

On the Title Page:

Item (76) Inventors should read: ~~Sengshin~~ Sengshiu Chung

Signed and Sealed this
Twenty-fifth Day of June, 2013

Teresa Stanek Rea
*Acting Director of the United States Patent and Trademark Office*